United States Patent [19]

Lenertz

[11] 4,275,984

[45] Jun. 30, 1981

[54] PARKING STAND

[75] Inventor: John B. Lenertz, Chaska, Minn.

[73] Assignee: Farmhand, Inc., Minneapolis, Minn.

[21] Appl. No.: 21,350

[22] Filed: Mar. 19, 1979

[51] Int. Cl.[3] ..... E02F 3/70

[52] U.S. Cl. ..... 414/686; 172/274

[58] Field of Search ..... 414/685, 686, 722, 723, 414/498; 172/272-275; 212/145, 189

[56] References Cited

U.S. PATENT DOCUMENTS

| | | | |
|---|---|---|---|
| 3,324,954 | 6/1967 | Westendorf | 414/686 X |
| 3,554,396 | 1/1971 | Demkiw | 172/273 X |
| 3,612,311 | 4/1969 | Eidy | 414/498 X |
| 3,805,980 | 4/1974 | Kisaka | 414/686 |
| 3,833,136 | 7/1974 | Spicer | 414/686 |
| 3,863,786 | 2/1975 | Frank | 414/686 |
| 3,949,889 | 4/1976 | Moe | 414/686 |
| 4,033,469 | 7/1977 | Frank | 414/686 |
| 4,065,009 | 12/1977 | Old | 414/686 |

FOREIGN PATENT DOCUMENTS 1372650 4/1964 France .

*Primary Examiner*—Stephen G. Kunin
*Assistant Examiner*—Terrance L. Siemens
*Attorney, Agent, or Firm*—Dorsey, Windhorst, Hannaford, Whitney & Halladay

[57] ABSTRACT

A parking stand for supporting an implement such as a front end loader when the implement is not in use including an extendable, elongated support leg pivotally secured near its upper end to a portion of the implement, a pin assembly for fixing the support leg in a plurality of extended positions, interlocking connection apparatus for retaining the support leg in its non-operative position and apparatus for limiting the pivotal movement of the elongated support leg.

15 Claims, 10 Drawing Figures

PARKING STAND

BACKGROUND OF THE INVENTION

The present invention relates generally to a parking stand for supporting a vehicle implement when not in use, and more particularly, to an improved parking stand for supporting an implement such as a front end loader.

The prior art includes many different types of parking stands and devices for supporting implements such as front end loaders when not in use. Many of these stands, such as those shown in U.S. Pat. Nos. 3,912,095 and 3,805,980, support the implement when not in use, but are intended to be detached and removed from the implement when the same is being used. For this reason, such stands are generally undesirable since removal of the stand from the implement often results in misplacement of the parking stand. Further, when disconnecting the implement from the vehicle, either the implement must be returned to the location where it was mounted onto the supporting vehicle or the parking stand must be transported to the new implement storage location, thus resulting in additional labor, lost time and general inconvenience.

In many other implements, the stand supporting mechanism is incorporated into the implement structure itself such as shown in U.S. Pat. Nos. 3,554,396 and 4,051,962. While these are generally acceptable and serve the function of supporting the implement when the same is not in use, they are normally designed and intended for use with implements having an independent main frame. In such implements, a portion of the main frame also serves as part of the supporting mechanism.

Still other implements in the prior art show parking stands intended to remain with the vehicle. Stands such as these are shown in U.S. Pat. Nos. 3,833,136, 3,991,890 and 3,949,889. Most include a parking stand element which is pivotable or movable with respect to a portion of the implement between a parking position and a use position. In many, however, significant effort and time is required to convert the same from a parking position to a use position, and vice versa.

In general, a parking stand of the type contemplated by the present invention is of greatest value when used in conjunction with a front end loader designed for quick attachment to or removal from the tractor so that the tractor can be used for other purposes. As a result, the parking stand must be so designed that it supports the front end loader in a position for quick and convenient attachment to the tractor. Furthermore, the parking stand must be so sized and located as to not restrict entrance or egress of the tractor to or from the loader.

Accordingly, there is a need in the art for an improved parking stand for an implement such as a front end loader which is intended to stay with the equipment, is generally unobtrusive, is quickly and easily moved between an operative and non-operative position and has the other desirable characteristics described above.

SUMMARY OF THE INVENTION

In contrast to the prior art, the present invention relates to improved parking stand for an implement such as a front end loader in which the stand is adapted to remain with the implement when the same is in use. Such stand is also foldable to a compact, unobtrusive structure when the same is not in use and is quickly and easily movable between non-operative and operative positions.

More particularly, the parking stand of the present invention includes an elongated leg member having its upper end pivotally secured to a portion of the implement and having a lower foot portion for engagement with the ground or other supporting surface. The elongated leg is comprised of at least two telescoping leg portions which are movable longitudinally with respect to each other. Thus, the two leg portions are extendable and retractable along the longitudinal axis of the elongated leg. The lower end of the leg also includes means adapted for engagement with a corresponding stop member on the implement to retain the elongated leg member in close association with a portion of the implement when the parking stand is not in use. The parking stand also includes means for limiting the pivotal movement of the elongated member and means for locking the extendable and retractable leg in a plurality of positions to lock the same in a supporting position as well as a folded or collapsed position.

Accordingly, it is an object of the present invention to provide an improved parking stand for an implement such as a front end loader which is connected with the implement and is adapted for remaining with the implement even during periods when the implement is in use.

Another object of the present invention is to provide an improved parking stand for an implement such as the front end loader which is unobtrusive and which is foldable to a compact, collapsed position when the implement is not in use.

A further object of the present invention is to provide an improved parking stand for an implement such as a front end loader which is quickly and easily converted from a non-operative position to an operative position, and vice versa.

These and other objects of the present invention will become apparent with reference to the drawings, the description of the preferred embodiment and the appended claims.

DESCRIPTION OF THE PREFERRED EMBODIMENT

Figure 1:
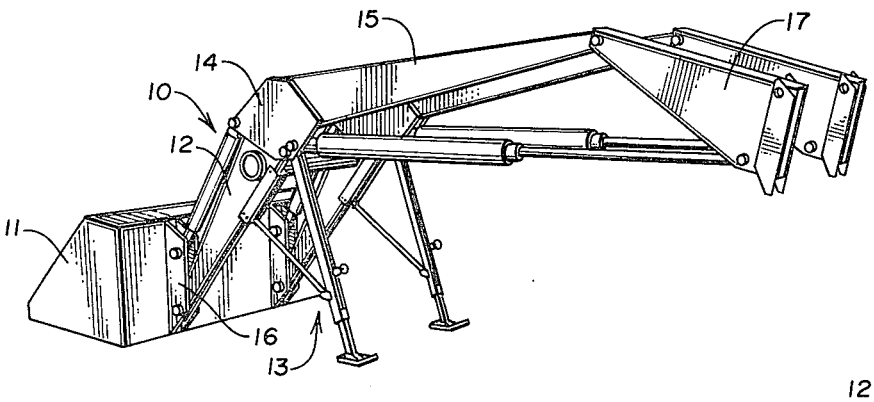
FIG. 1 is a pictorial view of a front end loader implement showing the parking stand of the present invention in its operative position.
Figure 2:
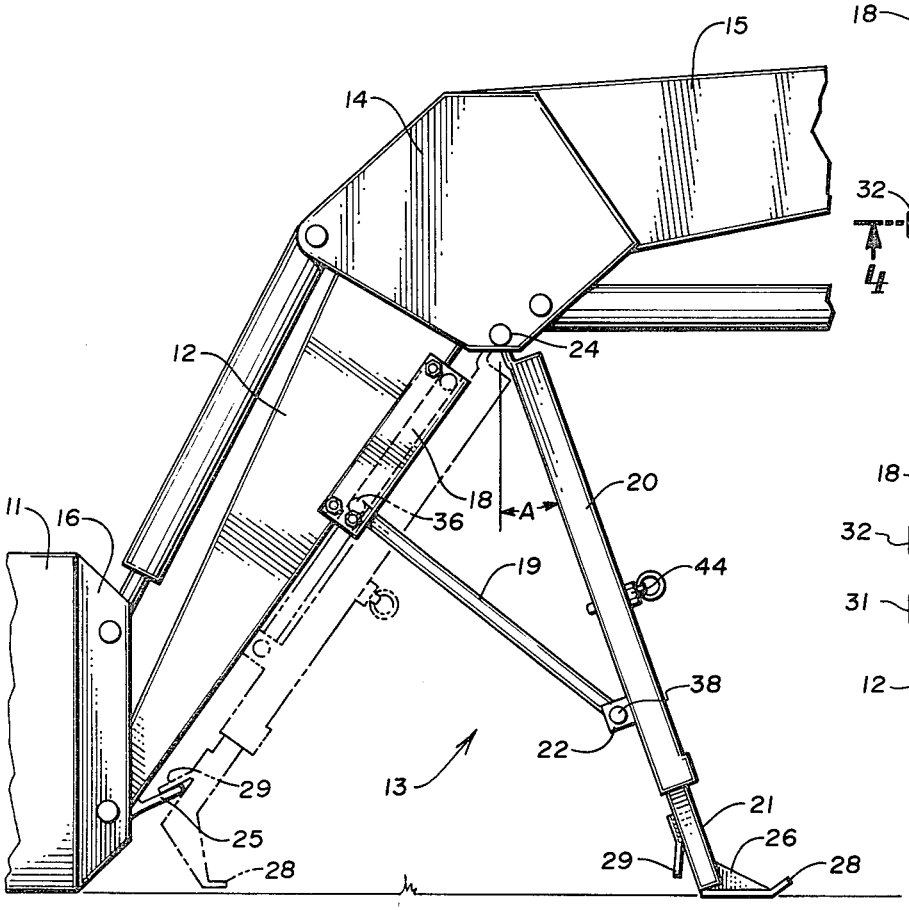
FIG. 2 is a side view of a portion of a front end loader implement showing the parking stand of the present invention in an operative position, with the non-operative position shown by broken lines.

Reference is first made to FIGS. 1 and 2 which show the parking stand 13 of the present invention in an operative position supporting a front end loader 10. As illustrated, the front end loader 10 includes a pair of laterally spaced side arms or side frame members adapted to be positioned on opposite sides of the tractor or other vehicle when in use. Each of the pair of side frame members includes a lower loader arm or lift frame member 12, an associated side lift frame arm 15 and an upright frame member 17. The side lift frame arm 15 and the lower lift frame member 12 on each side of the loader are rigidly secured together by an appropriate pair of connecting plates 14. The other end of the side lift arm 15 is pivotally connected to one of the upright frame members 17 while each of the lower ends of the loader lift arms 12 is pivotally secured to the bucket 11 through a pair of rear mounting plates 16.

When the front end loader 10 is not in use, it is supported by the parking stand of the present invention which is illustrated generally by the reference numeral 13 in FIG. 1. As shown in FIG. 1, the parking stand structure includes a pair of parking stand members associated with the pair of side frame members. With more specific reference to FIG. 2, each of the parking stand members includes an elongated support leg comprising the telescoping leg members 20 and 21 which are extendable and retractable with respect to each other. In general, as will be described in more detail below, the upper end of the supporting leg is pivotally connected with a portion of the implement while the lower end includes a foot portion 28 for engaging the ground or other supporting surface. The stand also includes a stop member 25 connected with a portion of the implement, a retaining bracket 29 adapted for cooperating engagement with the stop member 25 for retaining the stand in a folded position during non-use and a means in the form of the brace member 19 for limiting the pivotal movement of the support leg relative to the implement. Finally, the stand also includes a means in the form of the ring pin 44 for retaining the extendable and retractable support leg in selected positions during use and non-use.

Figure 6:
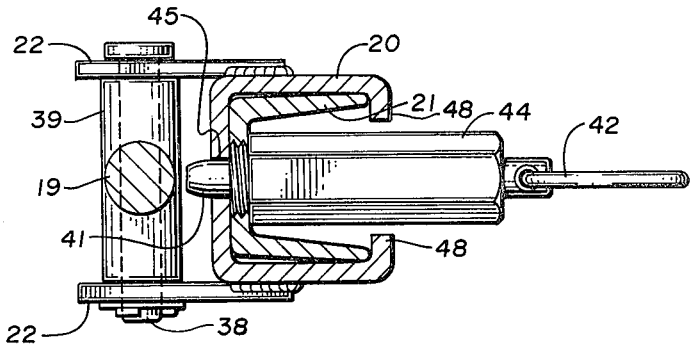
FIG. 6 is a view, partially in section, as taken along the section line 6—6 of FIG. 5.

As illustrated best in FIGS. 2, 5, 6 and 8, the elongated support leg includes an outer and upper elongated leg member 20 having a pivot bracket 35 and a pivot sleeve 23 at its upper end for pivotally connecting the member 20 between the pair of connecting plates 14 (FIGS. 1 and 2) via the pivot pin 24. As shown in FIG. 6, the outer leg member 20 is a channel member having a generally C-shaped cross-section with a pair of inwardly extending lip portions 48. These portions 48 assist in retaining the lower leg member 21 therein. The base portion of the elongated outer leg member 20 includes a plurality of holes or openings 45 through which a plunger end 41 of a ring pin assembly 44 extends to prevent relative longitudinal movement between the outer leg member 20 and the inner leg member 21. The leg member 20 also includes a pair of brackets 22 extending outwardly from the leg 20 toward the lift frame member 12 to pivotally support the brace 19. The brackets 22 are rigidly secured to the leg 20 by welding or other appropriate connecting means. A plate member 40 is welded across the open side of the leg member 20 at its lower end to give rigidity and strength to the member.

The inner and lower elongated leg member 21 has exterior dimensions smaller than the interior dimensions of the leg 20, thereby enabling it to slide within the generally C-shaped leg 20. As shown in FIG. 6, the lower leg 21 has a generally U-shaped cross-sectional configuration with a base portion adapted for sliding engagement with the base portion of the outer leg member 20. Due to the flange portions 48 of the outer leg member 20, the lower leg member 21 is retained within the leg 20 in sliding relationship along the longitudinal axis thereof.

As shown best in FIG. 2, the lower end of the lower leg member 21 includes a foot portion 28 for engaging the ground or other supporting surface. In one embodiment the foot portion 28 includes a flat lower surface for engagement with the ground or supporting surface and a brace member 26 extending between the foot 28 and the lower portion of the leg member 21 to rigidly secure the two elements together. A lower portion of the leg member 21 also includes an interlocking connection means for retaining the stand in its non-operative position. In the embodiment shown in FIG. 2, this means includes a retaining or interlocking connection bracket 29 securely connected with the outer surface of the base portion of the leg 21. In this embodiment, the retaining member 29 comprises an angled metal plate having a portion welded to the outer face of the leg member 21 and a portion extending outwardly from the leg 21 and opening downwardly. As illustrated best in FIG. 2, the retaining member 29 is adapted for engagement with a corresponding interlocking connection bracket in the form of the stop member 25 which is securely connected with a portion of the implement being supported. In the preferred embodiment, the stop member 25 is welded to a lower portion of the lift frame member 12 and includes a metal plate member extending outwardly from the arm 12 and opening upwardly. When the parking stand is in its folded or non-operative position, the retaining bracket 29 and stop member 25 are interlocked to prevent the parking stand from swinging free.

Figure 7:
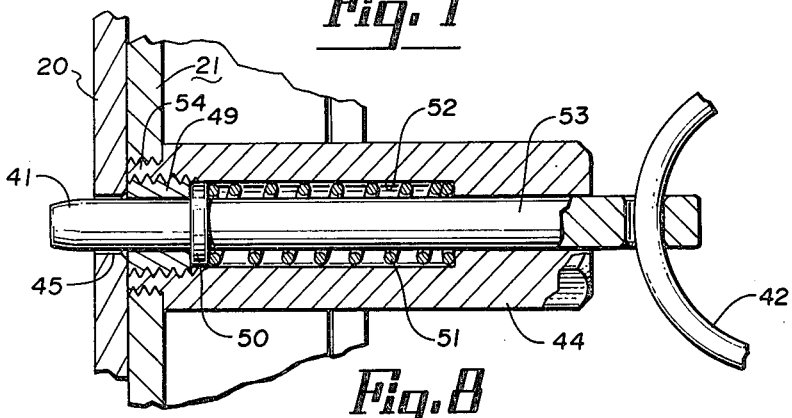
FIG. 7 is a detailed view, partially in section, showing the ring pin element and its association with the leg members.
Figure 8:
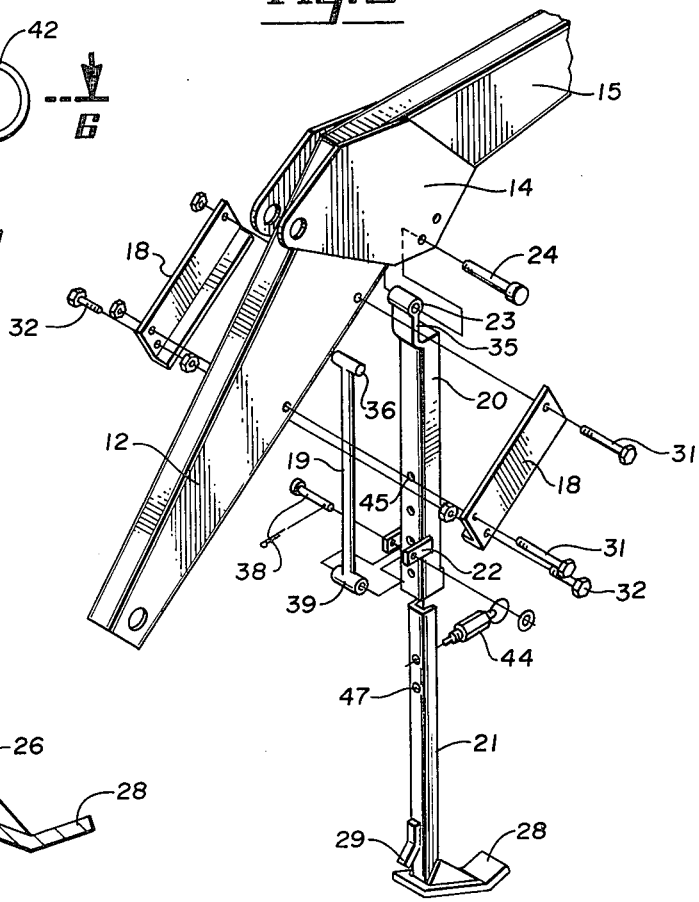
FIG. 8 is an exploded view of the parking stand of the present invention showing its relation to the lift frame members of a front end loader.

The lower leg member 21 includes two threaded holes 47 in its base portion for mounting of the ring pin element 44. The ring pin element 44 includes an exteriorly threaded portion adapted for threaded engagement with one of the threaded openings 47. The second threaded opening 47 is provided if an alternate height position is needed or desired. In this respect it is common practice to market the same front end loader and parking stand combination for use on different size tractors. The parking stand adjustment provided by pull pin mounting holes 47 and leg holes 45 permits adaptation of the loader-stand combination to both large and small tractors without further modification. The parking stand adjustment also enables the device to compensate for uneven ground conditions which may be encountered in farm use. As shown in FIGS. 6 and 7, the ring pin member 44 extends outwardly from the base of the leg member 21 where it is accessible for manual operation. As will be described in more detail below, the ring pin member 44 includes a plunger element 41 adapted for selective engagement with one of the holes 45 in the outer leg member 20. When the plunger member 41 extends through any one of the openings 45, relative movement between the leg members 20 and 21 is precluded. However, when the plunger member 41 is retracted, relative sliding movement between the members 20 and 21 is permitted.

The structure and operation of the ring pin member 44 is shown best in FIGS. 6 and 7. As shown, the ring pin member 44 includes an outer shell or body portion having an exteriorly threaded end portion 54 for threaded engagement with one of the interiorly threaded openings 47 in the lower leg member 21. The shell portion also defines an inner cylindrical chamber 52 within which a compression coil spring 51 is disposed for biasing the plunger member 41 outwardly. The plunger 41 is integrally connected with the elongated stem member 53 which extends throughout the member 44 and past one end. The outer end of the stem 53 which extends past the outer end of the shell includes an opening through which a ring 42 is disposed for manual retraction of the stem member 53, and thus the plunger 41. The stem 53 includes a flanged portion 50 against which the spring member 51 exerts its biasing action. The flange 50 in turn is retained by a portion 49 of the ring pin body. By pulling on the ring member 42, the stem 53 and thus the plunger 41 is retracted against the force of the spring 51. This in turn moves the plunger 41 out of engagement with the holes 45 in the leg member 20 and permits relative movement between the leg members 20 and 21. When the ring 42 is released, action of the spring 51 urges the stem 53 and plunger 41 toward the left as viewed in FIGS. 6 and 7 and thus into engagement with one of the openings 45 when proper alignment is achieved.

The parking stand of the present invention also includes means for limiting the pivotal movement of the elongated support leg relative to the implement. In the preferred embodiment, this means includes the elongated rigid brace member 19. The brace 19 includes an elongated rod of fixed length having a T-shaped sleeve portion 39 at its lower end and a T-shaped solid portion 36 at its upper end. The sleeve portion 39 is integrally formed with the lower end of the brace 19 and is positioned at relatively right angles with respect to the brace 19. The sleeve 39, and thus the brace 19, is pivotally mounted between the mounting brackets 22 by the pin member 38. In the preferred embodiment, the pin 38 is retained by a conventional cotter pin.

Figure 3:
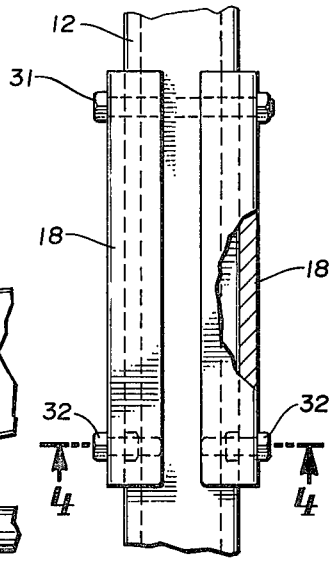
FIG. 3 is a plan view of a portion of the lift frame of a front end loader showing the guide members for the parking stand brace.
Figure 4:
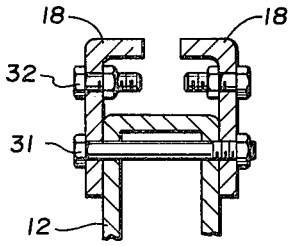
FIG. 4 is a sectional view as viewed along the section line 4—4 of FIG. 3.
Figure 5:
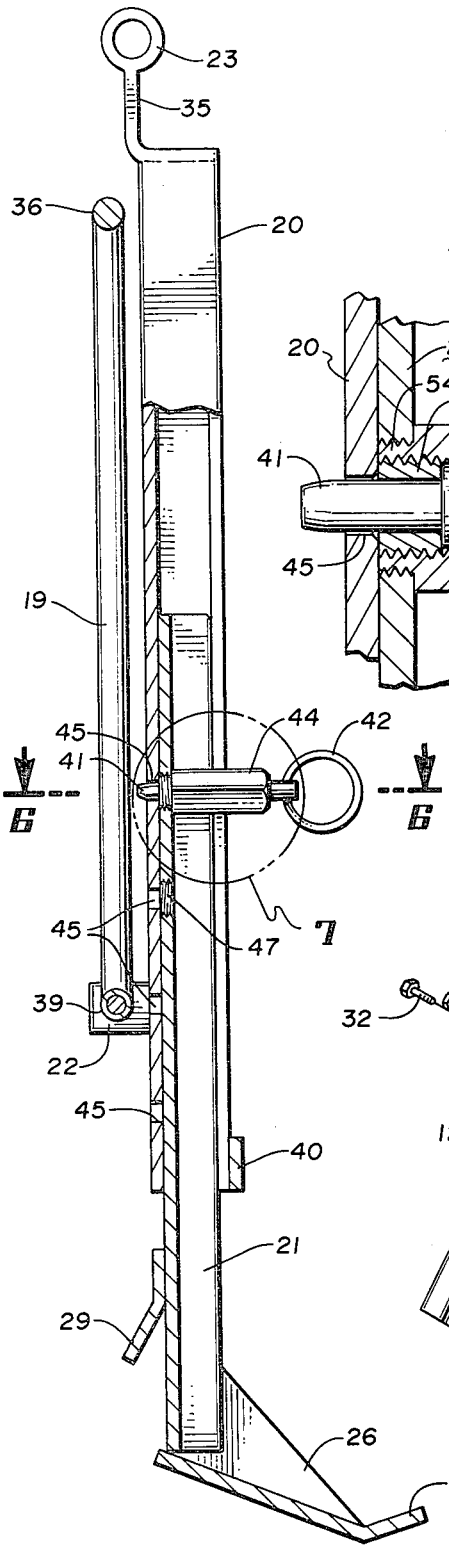
FIG. 5 is a side view, partially in section, of the parking stand in its collapsed or folded position.

As illustrated best in FIGS. 2, 3 and 4, the upper T-shaped end 36 is intended to be guided by and ride within the channel defined by the pair of guide members 18. The guide members 18, which have generally L-shaped cross-sections, are bolted to a portion of each of the lift frame arms 12 by the bolts or cap screws 31 to form a channel or track within which the end 36 may move. When bolted to the lift arms 12 in this manner, each pair of guides are spaced to permit free movement of the elongated brace 19 in the elongated slot or opening between the guides. The guides 18 are close enough to each other, however, to preclude the T-shaped end portion 36 from being removed. Cap screws or bolts 32 extend through each of the guide members at its lower end to serve as a stop and keep the T-shaped end 36 from falling out of the guide track when the stand is swung out. The bolts 32, however, are spaced enough to allow the brace 19 to pass between the bolts 32 to the folded or non-operative position shown by the broken lines in FIG. 2.

While the brace 19 may be of different lenghts, it should be sufficiently long to give the parking stand stability. In the preferred embodiment, it has been found that sufficient stability is achieved when the angle A (FIG. 2) between the leg 20 and the vertical is between about 20° and 30°. Also, in the preferred embodiment, the guide plates 18 are mounted to the lift frame 12 such that when the support leg is fully swung out into its supporting position, the brace 19 forms a self-locking (generally 90°) angle relative to the guide plates 18. During the operation of removing the tractor from or attaching the tractor to the front end loader, the latter may be pushed or pulled from front to rear. It is important both from a safety and convenience standpoint that the parking stand does not collapse under these conditions. In order to eliminate this possibility, the parking stand linkage geometry is designed to achieve a self-locking angle between brace 19 and the loader frame 12. This is an important feature of the invention in order to prevent accidental collapse of the parking stand and possible subsequent injury to persons in the area.

As mentioned above, the purpose of the brace 19 is to limit the pivotal movement of the leg member away from the lift frame arms 12 about the pivot 24. While the preferred embodiment shows use of the brace member 19 to limit such pivotal movement, it is contemplated that various other means may also be used such as a chain, cable or some other flexible member.

Figure 9:
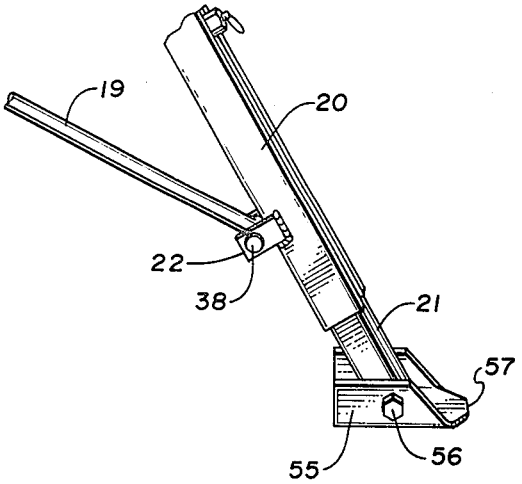
FIG. 9 is a pictorial view of a portion of the parking stand showing an alternate embodiment of the foot portion and means for interlocking the stand with the implement in a non-operative position.
Figure 10:
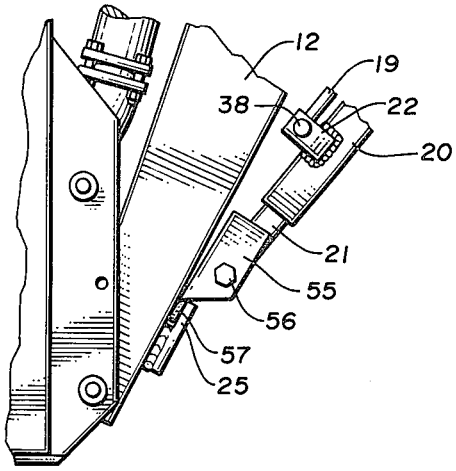
FIG. 10 is a side view of the alternate embodiment of FIG. 9 showing the stand in its non-operative position.

FIGS. 9 and 10 show an alternate embodiment of the foot and interconnecting means of the present invention. As shown in this embodiment, the foot portion 55 is pivotally secured to the lower end of the leg 21 by the pivot 56. The means connected or associated with the lower leg 21 for retaining or interlocking the stand with a portion of the implement in a non-operative position includes the portion 57 of the foot 55. The portion 57 is adapted to pivot and interlock with the stop member 25 in a non-operative position as shown in FIG. 10. An advantage of this alternate embodiment is that it eliminates the possibility of the foot portion hooking or catching on the end of the container or bin into which the material is being dumped. A further advantage is its ability to provide better support to the parking stand by automatically aligning to uneven ground conditions.

Having described the specific structure of the parking stand of the present invention, the operation can be understood as follows. When the implement or front end loader is connected with the tractor, each of the parking stand sections is in its folded or collapsed position as illustrated by the broken lines in FIG. 2. In this position, the bracket 29 is interlocked with the stop member 25 and the plunger member 41 of the ring pin 44 is engaged with the appropriate hole in the outer leg 20 to retain the leg in this position. When removal of the implement from the tractor is desired, the ring pin 44 is retracted by manually pulling on the ring 42. This retracts the plunger 41 (FIG. 5) and allows relative movement between the leg members 20 and 21. With the plunger 41 retracted, the lower leg 21 is slid upwardly to disengage the bracket 29 from the stop member 25 (FIG. 2) and then the entire elongated support leg is moved away from the lift frame member 12 about the pivot 24. During this pivotal movement, the brace 19 pivots downwardly about the pin 38 and the T-shaped portion 36 at the upper end of the brace 19 slides downwardly between the guides 18 to the position illustrated in FIG. 2. The lower leg member 21 is then slid downwardly to the desired position and the ring pin member 44 released, allowing the plunger member 41 to engage one of the openings 45 at the desired position. The above procedure is repeated for each of the parking stand sections. The front end loader is then fully supported by the parking stand members.

When the implement is desired to be used again and attached to the tractor, the connections between the loader and the tractor are made. Next, the ring pin 44 is retracted and the lower leg member 21 is slid upwardly within the outer leg member 20 and the entire elongated leg pivoted inwardly about the pivot 24 toward the lift frame members 12. When the leg is in close association with the members 12, the lower leg 21 is allowed to move downwardly so that the bracket 29 engages the stop member 25. The ring pin member 44 is then released, allowing the plunger member 41 to engage one of the holes 45 in the outer leg member 20 to prevent disengagement of the bracket 29 from the stop member 25. This same procedure is repeated for each of the parking stand sections.

Although the description of the preferred embodiment has been quite specific, it is contemplated that various changes and modifications could be made to the structure without deviating from the spirit of the present invention. Accordingly, it is intended that the scope of the present invention be dictated by the appended claims rather than by the description of the preferred embodiment.

I claim:

1. A parking stand for an implement comprising:

an elongated support leg pivotally secured near its upper end to a portion of said implement, said elongated support leg being extendable to a plurality of positions along its longitudinal axis and being pivotable between an operative position and a non-operative position;

means for fixing said elongated support leg in a plurality of extended positions;

interlocking connection means for retaining said elongated support leg in its non-operative position; and means for limiting the pivotal movement of said elongated support leg including an elongated member of fixed length having one end connected to a portion of said support leg and the other end connected with a portion of said implement.

2. The parking stand of claim 1 wherein said elongated support leg is comprised of at least two telescoping leg sections.

3. The parking stand of claim 2 wherein said elongated support leg includes an upper leg section pivotally secured near its upper end to a portion of said implement and a lower leg section having a ground engaging foot at its lower end, one of said upper and lower leg sections having an interior channel to facilitate sliding movement by the other of said upper and lower leg sections within said channel.

4. The parking stand of claim 3 wherein said upper leg section has an interior channel to facilitate sliding movement by said lower leg section therein.

5. A parking stand for an implement comprising:

an elongated support leg comprised of at least two telescoping leg sections, said support leg including an upper leg section pivotally secured near its upper end to a portion of said implement and a lower leg section having a ground engaging foot at its lower end, said upper leg section having an interior channel to facilitate sliding movement by said lower leg section within said channel causing said elongated support leg to be extendable to a plurality of positions along its longitudinal axis, said support leg being pivotable between an operative position and a non-operative position;

means for fixing said elongated support leg in a plurality of extended positions includes a plurality of holes in said upper leg section and means connected with said lower leg section having a retractable plunger and means biasing said plunger toward engagement with said holes;

interlocking connection means for retaining said elongated support leg in its non-operative position; and means for limiting the pivotal movement of said elongated support leg.

6. The parking stand of claim 5 wherein said means connected with said lower leg section is a ring pin member.

7. A parking stand for an implement comprising:

an elongated support leg comprised of at least two telescoping leg sections, said support leg including an upper leg section pivotally secured near its upper end to a portion of said implement and a lower leg section having a ground engaging foot at its lower end, said elongated support leg to be extendable to a plurality of positions along its longitudinal axis, said support leg being pivotable between an operative position and a non-operative position;

means for fixing said elongated support leg in a plurality of extended positions;

interlocking connection means for retaining said elongated support leg in its non-operative position including a first interlocking element connected with said lower leg section and a second interlocking element connected with a portion of said implement; and means for limiting the pivotal movement of said elongated support leg.

8. The parking stand of claim 7 wherein one of said first and second interlocking elements includes a first interlocking bracket opening downwardly and the other of said first and second interlocking elements includes a second interlocking bracket opening upwardly enabling interlocking of said interlocking brackets as a result of relative sliding movement between said upper and lower leg sections along the longitudinal axis of said support leg.

9. The parking stand of claim 8 wherein said first interlocking bracket is connected with said lower leg section of said second interlocking bracket is connected with a portion of said implement and wherein said brackets are interlocked as a result of downward movement of said lower leg section relative to said upper leg section.

10. The parking stand of claim 9 wherein said implement is a front end loader and said second interlocking bracket is connected with a portion of the lower lift arm of said implement.

11. A parking stand for an implement comprising:

an elongated support leg comprised of at least two telescoping leg sections, said support leg including an upper leg section pivotally secured near its upper end to a portion of said implement and a lower leg section having a ground engaging foot at its lower end, one of said upper and lower leg sections having an interior channel to facilitate sliding movement by the other of said upper and lower leg sections within said channel causing said elongated support leg to be extendable to a plurality of positions along its longitudinal axis, said support leg being pivotable between an operative position and a non-operative position;

means for fixing said elongated support leg in a plurality of extended positions;

interlocking connection means for retaining said elongated support leg in its non-operative position; and means for limiting the pivotal movement of said elongated support leg including an elongated member of fixed length having one end connected to a portion of said upper leg section and the other end connected with a portion of said implement.

12. The parking stand of claim 11 wherein said elongated member is a rigid rod having one end pivotally connected to a portion of said upper leg section and the other end slidably movable relative to a portion of said implement.

13. The parking stand of claim 12 having a pair of guide members connected with a portion of said implement and defining a path in which said other end of said pivotal movement limiting means is slidably movable.

14. The parking stand of claim 13 wherein said pivotal movement limiting means limits movement of said support leg to an angle of between about 20° and 30° with respect to the vertical.

15. The parking stand of claim 13 wherein said implement is a front end loader and said guide members are connected with a portion of the lower lift arm of said implement.

* * * * *